US011933066B2

(12) United States Patent
Irvine

(10) Patent No.: US 11,933,066 B2
(45) Date of Patent: Mar. 19, 2024

(54) POOL CLEANER BRUSH

(71) Applicant: ERUPTECH LLC, Atlanta, GA (US)

(72) Inventor: John Irvine, Atlanta, GA (US)

(73) Assignee: ERUPTECH LLC, Atlanta, GA (US)

( * ) Notice: Subject to any disclaimer, the term of this patent is extended or adjusted under 35 U.S.C. 154(b) by 283 days.

(21) Appl. No.: 17/404,788

(22) Filed: Aug. 17, 2021

(65) Prior Publication Data

US 2022/0056722 A1 Feb. 24, 2022

Related U.S. Application Data

(60) Provisional application No. 63/069,577, filed on Aug. 24, 2020.

(51) Int. Cl.
*E04H 4/16* (2006.01)
*A46B 5/00* (2006.01)

(52) U.S. Cl.
CPC ..... *E04H 4/1609* (2013.01); *A46B 5/0095* (2013.01); *A46B 2200/3073* (2013.01)

(58) Field of Classification Search
CPC ..... E04H 4/1609; A46B 5/0095
See application file for complete search history.

(56) References Cited

U.S. PATENT DOCUMENTS

| | | | |
|---|---|---|---|
| 2,982,971 | A | 5/1961 | Garaway |
| 3,872,533 | A | 3/1975 | Proffit |
| 4,356,582 | A | 11/1982 | Stephenson |
| 4,651,377 | A | 3/1987 | Staples |
| 4,982,754 | A | 1/1991 | Kallenbach |
| 5,802,667 | A | 9/1998 | Williams |
| 5,901,906 | A | 5/1999 | Bouldin |
| 6,119,707 | A | 9/2000 | Jordan |
| D654,989 | S | 2/2012 | Bloink et al. |
| D657,027 | S | 4/2012 | Bloink et al. |
| 9,249,590 | B2 | 2/2016 | Bloink et al. |
| 9,938,744 | B2 | 4/2018 | Gopalan et al. |
| 2010/0011521 | A1 | 1/2010 | Collins |
| 2012/0255579 | A1 | 10/2012 | Bloink et al. |
| 2017/0298645 | A1 | 10/2017 | Checri |
| 2020/0047196 | A1* | 2/2020 | Irvine ..... B05B 3/0486 |

FOREIGN PATENT DOCUMENTS

| | | | |
|---|---|---|---|
| CA | 2830963 | A1 | 10/2012 |
| EP | 2694759 | A1 | 2/2014 |
| WO | 2014071403 | A1 | 5/2014 |

OTHER PUBLICATIONS

Pool'N Brush, publication / on-sale date unknown, https://www.poolnbrush.com accessed Mar. 3, 2022; 5 pgs.

* cited by examiner

*Primary Examiner* — Shay Karls
(74) *Attorney, Agent, or Firm* — Perilla Knox & Hildebrandt LLP

(57) ABSTRACT

A pool cleaning brush including an attachment portion and at least one brush assembly. The attachment portion is configured for removably connecting with a portion of a tail sweep hose of a swimming pool cleaner. The at least one brush assembly includes at least one cleaning element thereon. As the swimming pool cleaner automatically moves through the swimming pool to clean the same, the pool cleaning brush is carried along with the tail sweep hose and engages the swimming pool surface to agitate, brush and clean the same.

13 Claims, 7 Drawing Sheets

POOL CLEANER BRUSH

CROSS-REFERENCE TO RELATED APPLICATION

This application claims the benefit of U.S. Provisional Patent Application Ser. No. 63/069,577 filed Aug. 24, 2020, the entirety of which is hereby incorporated herein by reference for all purposes.

TECHNICAL FIELD

The present invention relates generally to the field of automatic swimming pool cleaners or attachments and accessories for automatic swimming pool cleaners, and more particularly to a pool cleaner brush for removable attachment to a tail sweep hose of an automatic swimming pool cleaner.

SUMMARY

In example embodiments, the present invention relates to a pool cleaning brush for removable attachment to a tail sweep hose of an automatic swimming pool cleaner. As the tail sweep hose whips back and forth along the pool surface, the brush according to the present invention engages with the same to agitate, brush and/or polish the same as desired.

In one aspect, the present invention relates to a pool cleaning brush including an attachment portion and at least one brush assembly. In example embodiments, the at least one brush assembly includes a platform having an upper surface and a lower surface, and wherein at least one cleaning element is provided on at least one of the upper or lower surfaces. In example embodiments, the at least one brush assembly is double-sided such that both the upper and lower surfaces of the platform comprise at least one cleaning element connected thereto. In example embodiments, a pair of brush assemblies are connected to opposite sides of the attachment portion and outwardly extend therefrom. In example embodiments, the brush assemblies are generally connected to the attachment portion and are oriented to maintain a planar and parallel relationship relative to each other.

In example embodiments, a plurality of cleaning elements outwardly extend from upper and lower surfaces of the platforms, and wherein the extension of the cleaning elements is generally uniform so as to define a flat or uniformly-planar brush. In example embodiments, the attachment portion comprises a pair of axially-aligned and spaced-apart retaining rings, and a pair of radial fingers are positioned between the spaced-apart retaining rings and oppositely-extend along a radial path towards each other to define a slit or channel between the free ends thereof. In example embodiments, at least the attachment portion is substantially flexible and resilient so as to permit deformation thereof such that a portion of a tail sweep hose can be movably received therewith.

In example embodiments, the attachment portion is configured for removably connecting with a portion of a tail sweep hose, the attachment portion being sized relative to the tail sweep hose so as to permit the attachment portion to move along at least a portion of the length of the tail sweep hose and to freely permit rotation of the attachment portion about the tail sweep hose. In example embodiments, the attachment portion and at least one brush assembly are integrally formed from a single material by plastic injection molding. In example embodiments, the material comprises polyurethane. In example embodiments, the single-material, plastic-injection-molded brush is substantially light-weight and weighs about 10 grams.

In another aspect, the present invention relates to a brushing component for use with a pool cleaner including an attachment portion, at least one platform, and at least one cleaning element. In example embodiments, the attachment portion is configured for removable attachment with a portion of a tail sweep hose. In example embodiments, the attachment portion is configured to permit the same to move along and around the tail sweep hose to allow the entire brush cleaning surface to maintain full contact with all pool surfaces regardless of horizontal or vertical orientation. In example embodiment, the at least one platform includes at least one surface and is connected with the attachment portion. In example embodiments, at least one cleaning element is connected with the at least one surface and outwardly extends therefrom.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 9:
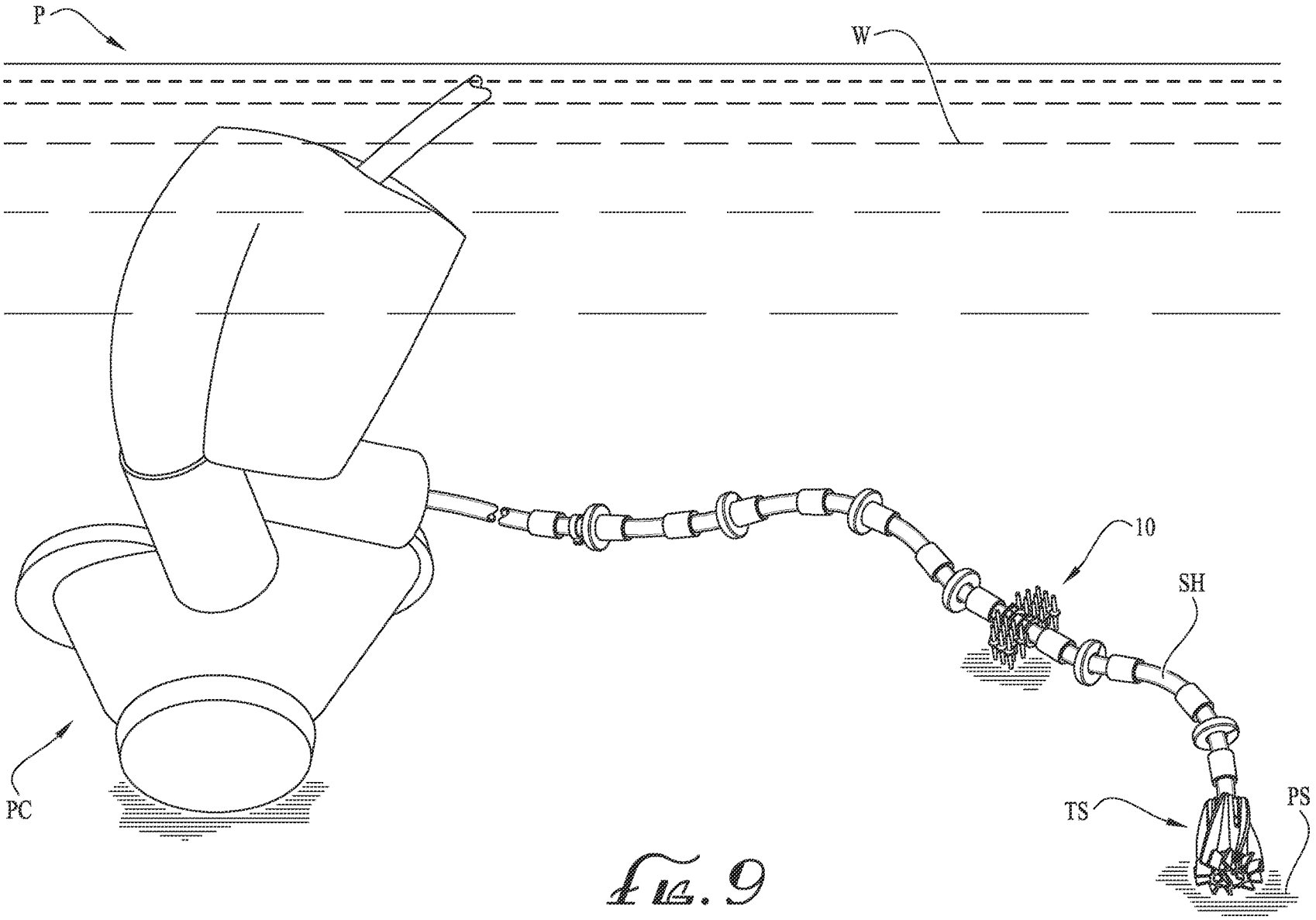
FIG. 9 is a perspective view of an automatic pool cleaner within a swimming pool and comprising the tail sweep hose and pool cleaner brush of FIG. 1.

With reference now to the drawing figures, wherein like reference numbers represent corresponding parts throughout the several views, FIGS. 1-4 show a tail sweep hose SH comprising a first end for attachment to an automatic swimming pool cleaner and a second end comprising a spray diffuser TS attached thereto. According to example embodiments of the present invention, a pool cleaner brush 10 is preferably removably coupled to a portion of the tail sweep hose SH between the first and second ends, and for example, rides along with the tail sweep hose SH as the automatic swimming pool cleaner PC is submerged in the water W of the swimming pool P actively cleaning the same (and with the tail sweep hose SH and pool cleaning brush 10 attached thereto whipping back and forth and sliding along the pool surfaces PS to help dislodge dirt and debris to clean the pool surfaces SP, and agitate and suspend debris in the water W for removal by the pool skimmer and filtration system—see FIG. 9).

According to example embodiments, the spray diffuser TS as depicted herein can be in the form of a diffuser for a pool cleaner tail sweep as described in U.S. Published Patent Application Serial No. US2020/0047196 (application Ser. No. 16/531,461), the entirety of which is incorporated by reference herein for all purposes.

In example embodiments, the pool cleaner brush 10 is configured to be removably attachable with the tail sweep hose SH. According to example embodiments, the pool cleaner brush 10 is sized relative to the hose such that the brush 10 can freely rotate about the hose SH and/or at least partially move along the length of the hose SH, similar to spaced-apart collars or stops that contain wear rings. As such, according to some example embodiments of the present invention, the pool cleaning brush 10 is movably and/or rotatably attachable with the tail sweep hose SH. For example, the pool cleaner brush 10 can freely rotate about the hose SH so as to provide for self-leveling or orienting (regardless of the surface relative to the cleaner—e.g., steps, walls and/or other features) as will be described in greater detail below.

Figure 1:
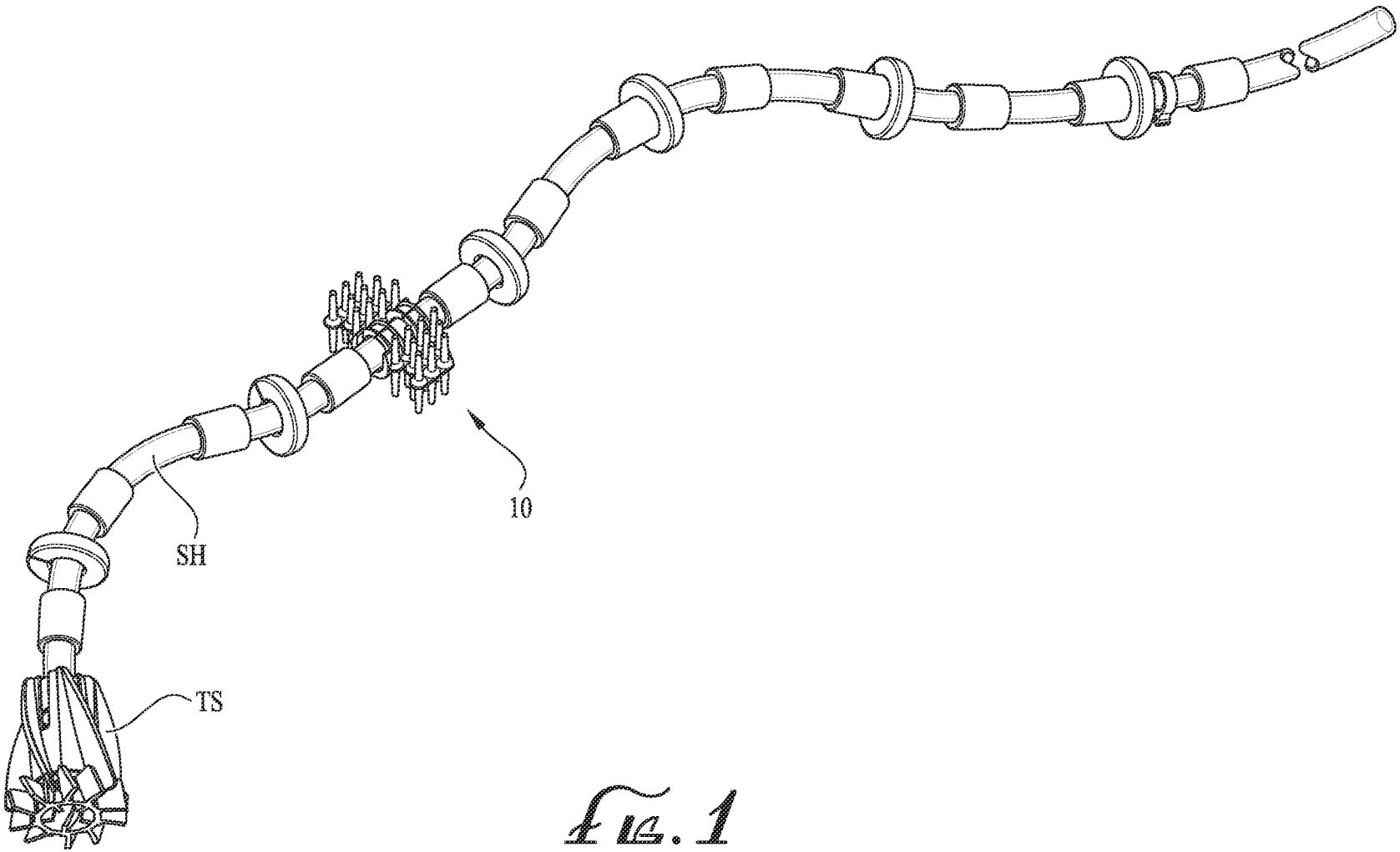
FIG. 1 is a top perspective view of a tail sweep hose comprising a pool cleaner brush removably attached thereto according to an example embodiment of the present invention.
Figure 2:
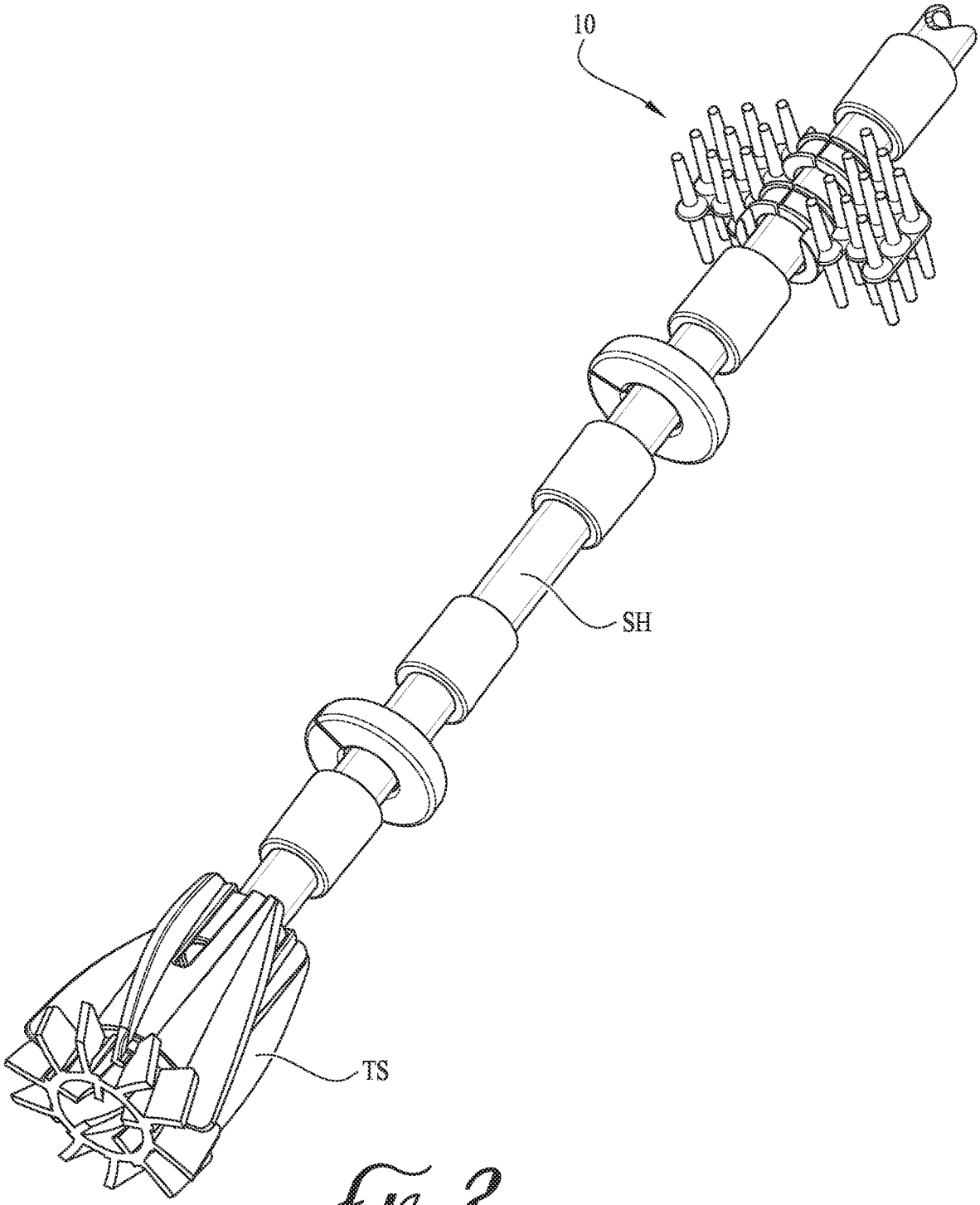
FIG. 2 is a perspective view of a portion of the tail sweep hose comprising the pool cleaner brush removably attached thereto of FIG. 1.
Figure 3:
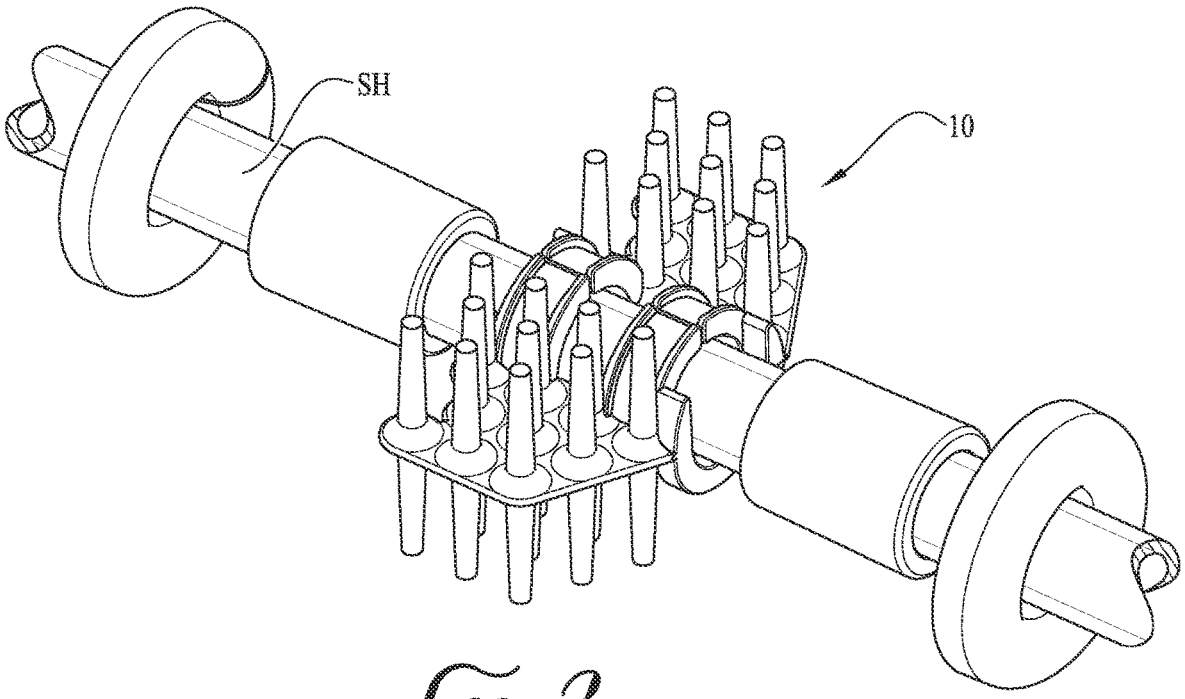
FIG. 3 is a side perspective view of the tail sweep portion and pool cleaner brush of FIG. 2.
Figure 4:
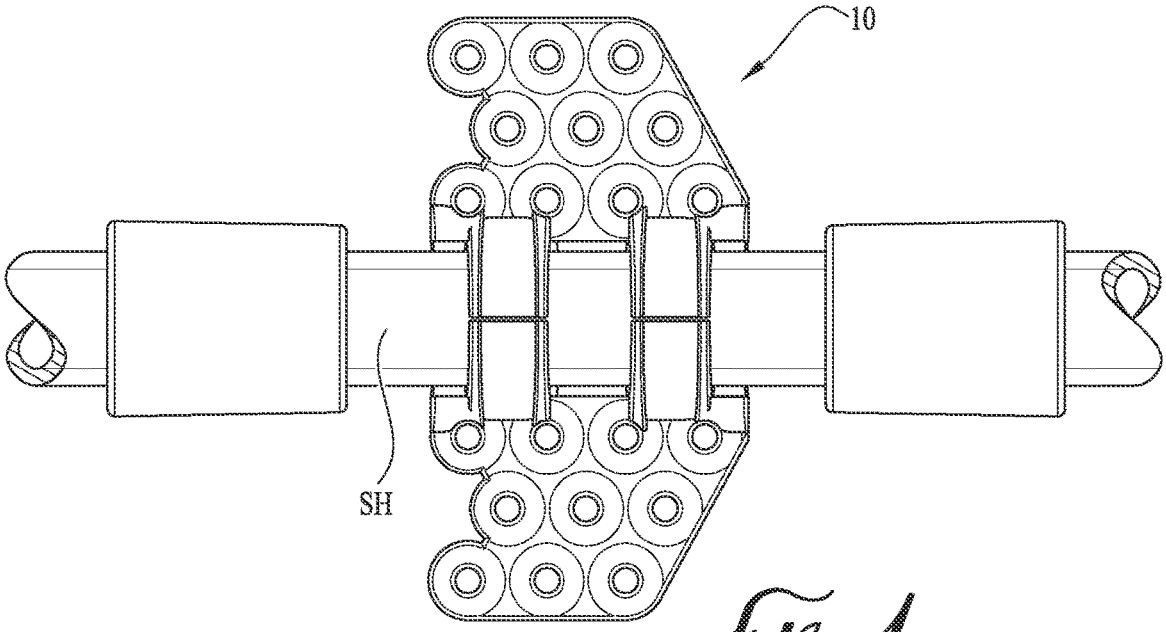
FIG. 4 is a top perspective view of the tail sweep portion and pool cleaner brush of FIG. 3.
Figure 5:
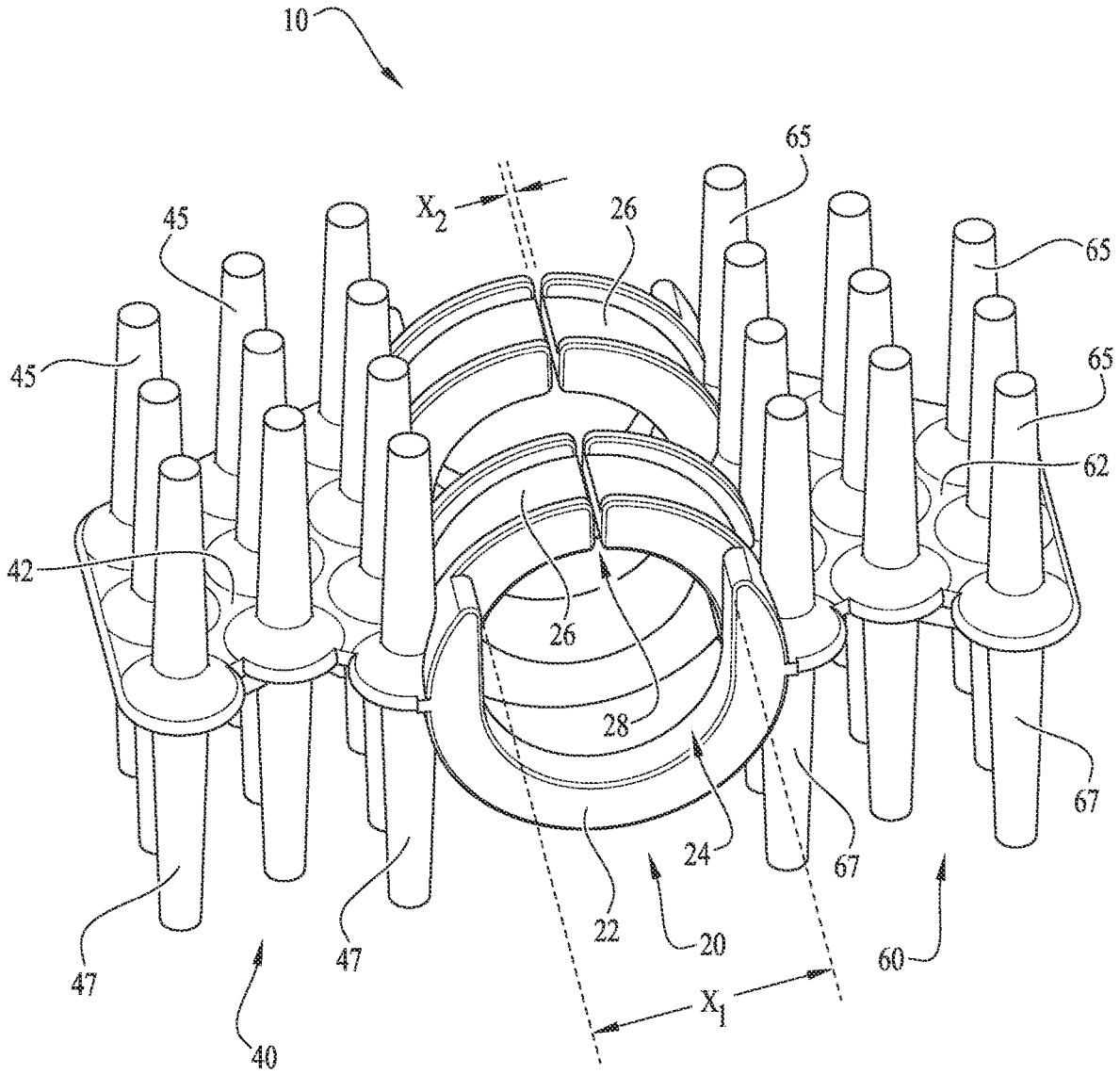
FIG. 5 is a top perspective view of the pool cleaner brush of FIG. 4.
Figure 6:
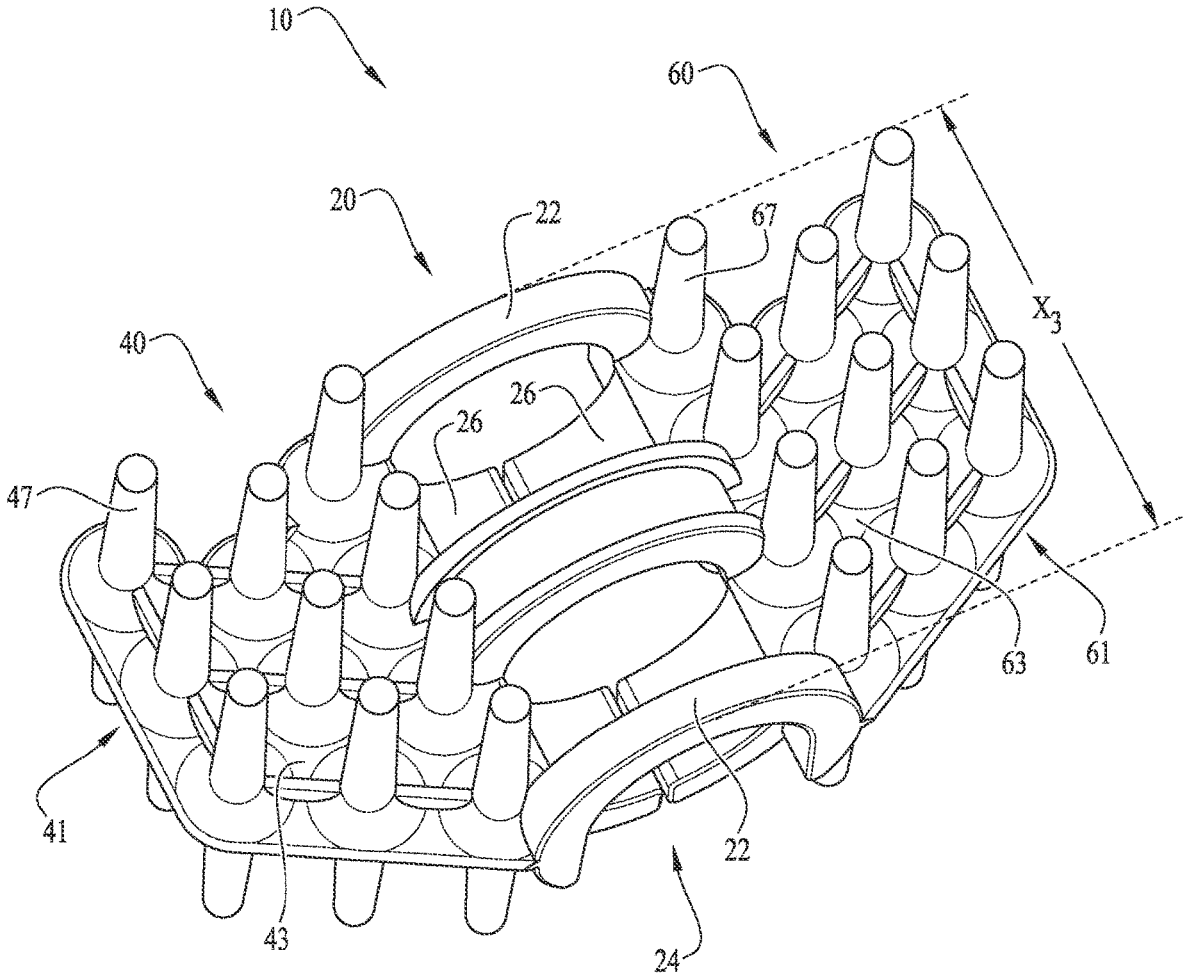
FIG. 6 is a bottom perspective view of the pool cleaner brush of FIG. 4.

FIGS. 5-8 show the pool cleaning brush 10 in greater detail. As depicted, the brush 10 comprises a central connection or attachment portion 20, and a pair of brush assemblies 40, 60 extending from the attachment portion 20. According to example embodiments, the brush assemblies 40, 60 comprise outwardly directed wings or platforms 41, 61 extending from the attachment portion 20 and comprising at least one cleaning element extending therefrom. According to one example embodiment, each side surface (e.g., upper 42, 64 and lower 43, 63) of the respective platforms 41, 61 comprise at least one cleaning element 45, 47, 65, 67 outwardly extending from its respective surface. For example, as depicted in FIGS. 5-6, at least one cleaning element 45 extends from upper surface 42 of platform 41, at least one cleaning element 47 extends from lower surface 43 of platform 41, at least one cleaning element 65 extends from upper surface 62 of platform 61, and at least one cleaning element 67 extends from lower surface 63 of platform 61. According to one example embodiment of the present invention, each of the cleaning elements 45, 47, 65, 67 define a spaced-apart matrix of cleaning elements 45, 47, 65, 67, for example, wherein about ten cleaning elements project from each surface of each platform 41, 61.

Figure 7:
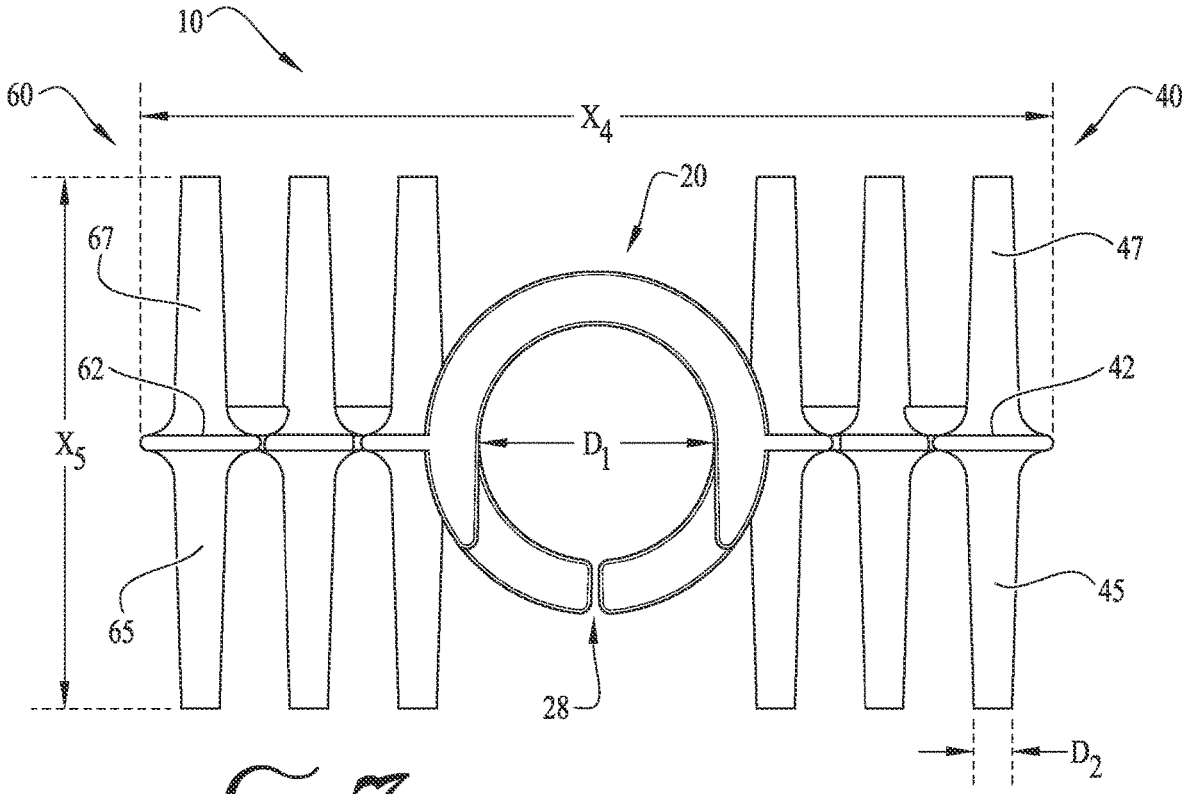
FIG. 7 is a side plan view of the pool cleaner brush of FIG. 4.
Figure 8:
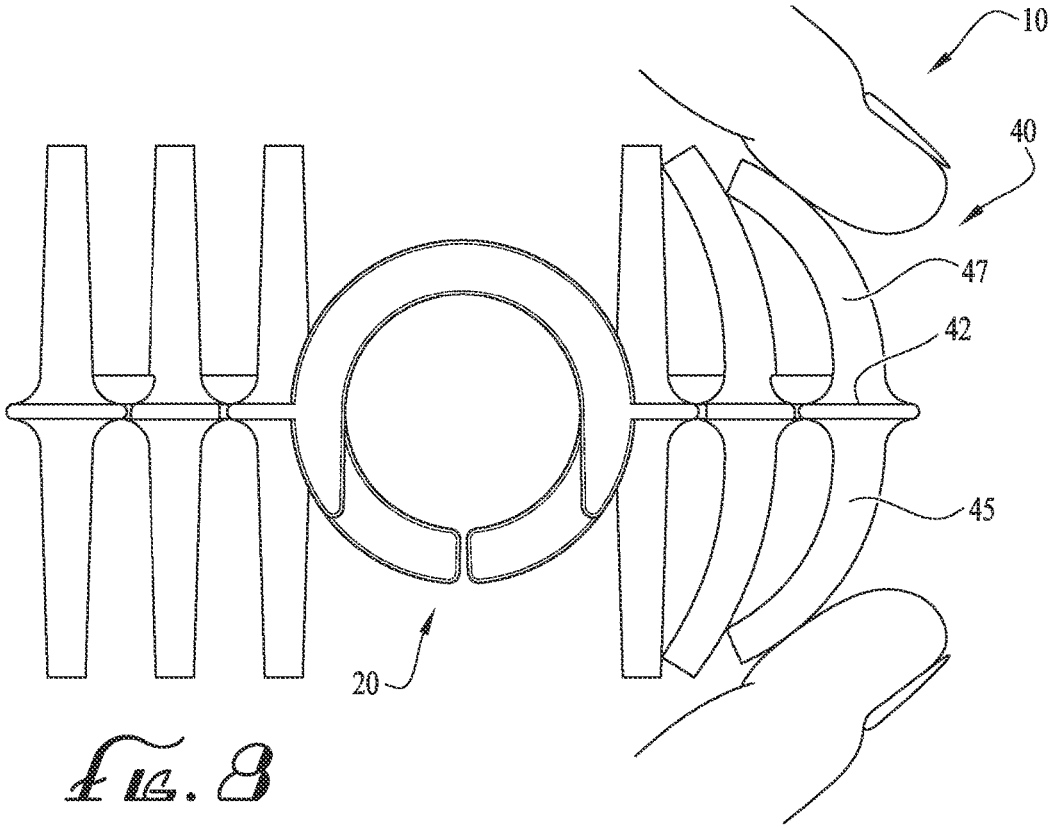
FIG. 8 is a side perspective view of the pool cleaner brush of FIG. 7, and showing a user exhibiting the flexibility of attachment and brush portions of the pool cleaner brush according to an example embodiment of the present invention.

According to example embodiments, the attachment portion 20 comprises at least one ring or collar 22 comprising a slit or channel to permit the elastic deformation thereof for attachment with the tail sweep hose SH. For example, according to one preferred embodiment, the attachment portion 20 comprises a pair of retaining rings 22 that are spaced apart and axially aligned with respect to each other. In example embodiments, a slit or channel 24 is defined in each of the retaining rings 22 to allow for attachment of the same to the tail sweep hose SH. A pair of arcuate or radial fingers 26 are positioned between the retaining rings 22 and oppositely-extend from either platform 41, 61 along a radial path towards each other to define a slit or channel 28 between the free ends thereof. According to example embodiments, the channel 24 defines a width X1 of between about 0.05-0.70 inches, for example, about 0.50 inches according to one example embodiment. The channel 28 defines a width X2 of between about 0.05-0.50 inches, for example, about 0.1 inches according to one example embodiment. According to example embodiments, the retaining rings 22 define an inner diameter D1 of between about 0.50-1 inch, for example, about 0.55 inches according to one example embodiment. As shown in FIG. 7, the radial fingers 26 extend along a radial path that is generally similar to the radial path of the retaining rings 22. According to example embodiments, the inner diameter D1 can be smaller, the same, or larger than the outer diameter of the tail sweep hose SH. According to the embodiment as depicted herein, the inner diameter D1 of the tail sweep hose SH is at least partially larger than the outer diameter of the tail sweep hose, for example, so as to permit the brush 10 to move along and/or rotate about at least a portion of the tail sweep hose SH. According to alternate example embodiments, the attachment portion 20 can preferably be configured to permit removable attachment to the tail sweep hose SH as desired. Furthermore, the attachment portion can preferably be configured to permit movement and/or rotation relative to the tail sweep hose SH when the brush 10 is removably attached thereto.

As depicted in FIG. 7, the platforms 41, 61 generally symmetrically-extend outwardly from opposite sides of the attachment portion 20. The platforms 41, 61 can preferably be integrally formed with the attachment portion 20, or for example, the platforms can be separate and configured for permanent or removable attachment with the attachment portion 20. In example embodiments, the platforms 41, 61 are generally comprised of wing-like members having upper surfaces 42, 62 and lower surfaces 43, 63. According to one example embodiment, the platforms 41, 61 can comprise any desired outer shape comprising one or more sides and pathways (e.g., linear, angled, curved, undulating, non-linear, etc.). Referring to FIG. 6, the width X3 or extension of the brush 10 (e.g., front-to-back measurement) is generally between about 1-4 inches, for example, about 1.3 inches according to one example embodiment. And referring back to FIG. 7, the brush 10 defines a side-to-side dimension X4 of between about 1-4 inches, for example, about 2.5 inches according to one example embodiment. According to example embodiments, the height or span X5 from an end of one of the cleaning elements to an end of one of the other cleaning elements (oppositely extending therefrom) is generally between about 1-3 inches, for example, about 1.5 inches according to one example embodiment.

According to example embodiments, the cleaning elements as described herein (45, 47, 65, 67) can preferably be configured as desired. For example, preferably the size, shape, type, pattern, configuration, etc. of the cleaning elements can be chosen as desired. According to one example embodiment, at least one of the cleaning elements comprises at least one flexible and resilient brushing material, which can be formed from a plurality of strands of a durable material, such as nylon, polyester, polyurethane, or carbon fiber. According to some example embodiments, strips or blades of a resilient, flexible material such as rubber or silicon can be used. For example, according to one example embodiment, the cleaning elements can comprise a combination of one or more strands of the durable material such as nylon, polyester, polyurethane, or carbon fiber, and one or more strips or blades of the resilient, flexible material such as rubber or silicon, which can be generally evenly distributed on the platforms, or for example, only provided along one or more desired portions of the platforms 41, 61 thereof. According to another example embodiment, a cleaning or polishing pad can be removably attached to one or both of the platforms 41, 61. According to yet another example embodiment, the cleaning elements comprise an array of substantially cylindrical projections (45, 47, 65, 67) outwardly extending from one or more surfaces of the platforms 41, 61 (as depicted in FIGS. 1-9).

According to one example embodiment and as depicted in FIG. 7, the cylindrical projection comprises a diameter D2 of between about 0.02-0.3 inches, for example, about 0.10 inches according to one example embodiment. Optionally, the diameter D2 can be chosen as desired, or for example, the diameter D2 of the cylindrical projections can vary as desired, for example, such that at least a portion of the cylindrical projections can comprise a first diameter D2 and the other portion of the cylindrical projections can comprise a second diameter D2. According to example embodiments of the present invention, the cylindrical projections are at least rigid enough to maintain a substantially linear extension from the surfaces (and support the weight of the tail sweep hose SH connected thereto), but for example, the cylindrical projections still provide for a substantial amount of elastic deformation (see FIG. 8).

In example embodiments, the cylindrical projections (and the patterned spacing thereof) are preferably robust and are substantially rigid so as to maintain a stable and level platform for scrubbing, and for example, are less likely to trap debris like leaves, hair, nuts, etc. Furthermore, the cylindrical projections of the pool cleaning brush 10 offer and make available a substantially large surface area for contact with the pool surface, for example, compared to prior pool sweep brushes such as U.S. Pat. No. 4,356,582, which discloses a wear ring incorporating a radial arrangement of bristles. The prior radial arrangement of bristles of the wear ring only permits a small fraction of its bristles to scrub the surface of the pool at a time, and thus is extremely inefficient and provides minimal scrubbing results (if any).

The cylindrical projections may be integrally formed with the platforms 41, 61, or for example, an over-molding or co-molding manufacturing process can be provided so as to permanently secure a secondary over-molded or co-molded pattern of cylindrical projections (or shaped otherwise) to the platforms (upper and/or lower surfaces) as desired. The co-molded or over-molded portions can be of the same or another desired material. According to another example embodiment, the cylindrical projections can be separately formed and permanently or removably connected with the platforms in a desired pattern/configuration.

According to some example embodiments, the at least one cleaning element extending from one surface of one of the platforms can be configured to be different than another at least one cleaning element extending from another surface of at least one of the platforms. For example, according to example embodiments, the cleaning elements can be catered to a desired function (e.g., clean, polish, etc.) and/or pool surface (e.g., Pebble Tec, vinyl, smooth, rough, etc.). Thus, according to example embodiments, the cleaning elements can be configured as desired to accomplish a desired function for a desired pool surface. Or for example, according to some example embodiments, multiple brush types and/or pads can be provided on the brush 10, for example, wherein each of the side surfaces (42, 43, 62, 63) of the platforms 41, 61 is capable of retaining (or otherwise supporting) a desired brush type and/or pad, and thus, provides for the ability of the brush 10 to comprise at least four different brush types and/or pads while being connected to the tail sweep hose SH. According to alternate example embodiments, multiple brush types and/or larger and spaced-apart cylindrical projections can be provided on one or more surfaces of the platforms 41, 61 as desired.

According to example embodiments, the brush 10 as described and shown herein is manufactured by a plastic injection molding process, for example, wherein a mold of the brush 10 is provided (e.g., the tool) and assembled with a plastic injection press, for example, so as to inject plastic at high temperatures within a void of the tool that is an identical copy of the brush 10. According to one example embodiment, the brush 10, when manufactured by plastic injection molding, provides an integral, one-piece and low-cost product which may not require any post-process manufacturing (e.g., polishing, quality review for flashing, assembly, etc.). According to one example embodiment, the brush 10 is formed from a single material (e.g., polyurethane) and weighs about 10 grams. According to another example embodiment, the brush 10, when injection molded, even though integrally formed as one piece, can comprise multiple materials, or for example, a co-molding process can be provided as desired. According to some example embodiments, one or more portions of the brush 10 can undergo an over-molding process as desired, or for example, during or right after the initial injection molding process (for example, without removing the piece from the mold). Optionally, according to other example embodiments of the present invention, the brush 10 as described herein can be manufactured according to various other manufacturing processes, and for example, can be formed from one or more materials as desired.

In use, the pool cleaning brush 10 preferably movably mounts to a portion of the tail sweep hose SH between a pair of spaced apart stops, collars or wear ring retainers. Preferably, when desired to attach or remove the brush 10 to/from the tail sweep hose SH, the attachment portion 20 is sufficiently elastically deformable such that the width X2 can exceed the outer diameter of the tail sweep hose SH, which causes the widths W1 of the channels 24 to similarly exceed the outer diameter of the tail sweep hose SH, and thus, attachment or detachment can occur. Otherwise, after attachment of the attachment portion 20 of the brush 10 with the tail sweep hose SH, the attachment portion 20 remains "tethered" or generally constrained to freely move along a portion of the tail sweep hose SH (and rotate therearound) between two collars or wear ring stops. According to example embodiments, the brush 10 rotates automatically and randomly when the tail hose lifts off the pool surface. According to example embodiments, due to the construction of the cylindrical projections, the brush 10 (and various other embodiments as described herein) are preferably long lasting and wear evenly along with the wear rings as is typical on a tail sweep hose SH.

According to some example embodiments of the present invention, the pool cleaning brush 10 as described herein is disposable, for example, such that the brush 10 is recycled or discarded once the at least one cleaning element is worn out and no longer effective at brushing against the pool surface. As such, a user or other operator can remove the used brush 10 from the tail sweep hose SH and installs a new brush 10. According to another example embodiment, the attachment portion of the brush 10 can be configured to be reusable, and for example, separate cartridges or other individual brush or cleaning attachment members (of any desired brush, bristle, pad, etc.) can be removably connected to the attachment portion. Thus, according to some example embodiments, the refillable cartridges or attachment members can be provided to easily "refresh" the cleaning elements without requiring that the entirety of the brush 10 be discarded.

According to another example embodiment of the present invention, one or more portions of the brush 10 can be configured for removable engagement with a wear ring of the tail sweep hose assembly, for example, such that the brush 10 removably engages the wear ring rather than the tail sweep hose SH itself. Accordingly, the brush 10 is limited in its movement capabilities (e.g., since the spaced-apart collars limit movement of the wear ring), however, the brush 10 would still provide the desired functionalities. Thus, according to some example embodiments, the attachment portion of the brush can comprise a cavity or other receiving area to be removably fitted/connected with at least a portion of the wear ring. According to some example embodiments, the wear ring is sized and shaped so as to provide complementary coupling features for connecting with the attachment portion of the brush. According to other example embodiments, the attachment portion can be configured for removable engagement with a conventional wear ring. In example embodiments, once the brush is worn down and is no longer functioning to brush the pool surface, the brush can be easily disconnected from the wear ring and a new brush can be attached.

While the invention has been described with reference to example embodiments, it will be understood by those skilled in the art that a variety of modifications, additions and deletions are within the scope of the invention, as defined by the following claims.

What is claimed is:

1. A pool cleaner sweep hose brush comprising:

an attachment portion configured for movable coupling to a tail sweep hose of a pool cleaner; and at least one brush assembly connected to at least a portion of the attachment portion, wherein the movable coupling of the attachment portion with the tail sweep hose is configured to provide self-leveling orientation of the at least one brush assembly along a pool surface as the tail sweep hose moves back and forth during operation of the pool cleaner; and wherein the attachment portion comprises a pair of axially-aligned and spaced-apart retaining rings, and a pair of radial fingers are positioned between the spaced-apart retaining rings and oppositely-extend along a radial path towards each other to define a slit or channel between the free ends thereof.

2. The pool cleaning brush of claim 1, wherein the at least one brush assembly comprises a platform comprising an upper surface and a lower surface, and wherein at least one cleaning element is provided on at least one of the upper or lower surfaces.

3. The pool cleaning brush of claim 2, wherein the at least one brush assembly is double-sided such that both the upper and lower surfaces of the platform comprise at least one cleaning element connected thereto.

4. The pool cleaning brush of claim 2, wherein a plurality of cleaning elements extend outwardly from upper and lower surfaces of the platform, and wherein the extension of the cleaning elements is generally uniform so as to define a flat or uniformly-planar brush.

5. The pool cleaning brush of claim 1, wherein a pair of brush assemblies are connected to opposite sides of the attachment portion and outwardly extend therefrom.

6. The pool cleaning brush of claim 5, wherein the brush assemblies are generally connected to the attachment portion and are oriented to maintain a planar and parallel relationship relative to each other.

7. The pool cleaning brush of claim 1, wherein at least the attachment portion is substantially flexible and resilient so as to permit deformation thereof such that a portion of a tail sweep hose can be movably received therewith.

8. The pool cleaning brush of claim 1, wherein the attachment portion is configured for removably connecting with a portion of a tail sweep hose, the attachment portion being sized relative to the tail sweep hose so as to permit the attachment portion to move along at least a portion of the length of the tail sweep hose and to freely permit rotation of the attachment portion about the tail sweep hose.

9. The pool cleaning brush of claim 1, wherein the attachment portion and at least one brush assembly are integrally formed from a single material by plastic injection molding.

10. The pool cleaning brush of claim 9, wherein the material comprises polyurethane.

11. The pool cleaning brush of claim 10, wherein the single-material, plastic injection molded brush is substantially light and weighing about 10 grams.

12. A pool cleaning brush comprising:

an attachment portion; and at least one brush assembly connected to at least a portion of the attachment portion;

wherein the attachment portion comprises a pair of axially-aligned and spaced-apart retaining rings, and a pair of radial fingers are positioned between the spaced-apart retaining rings and oppositely-extend along a radial path towards each other to define a slit or channel between the free ends thereof.

13. The pool cleaning brush of claim 12, wherein at least the attachment portion is substantially flexible and resilient so as to permit deformation thereof such that a portion of a tail sweep hose can be movably received therewith.

* * * * *